US005926785A

United States Patent [19]

Akamine et al.

[11] Patent Number: 5,926,785

[45] Date of Patent: Jul. 20, 1999

[54] SPEECH ENCODING METHOD AND APPARATUS INCLUDING A CODEBOOK STORING A PLURALITY OF CODE VECTORS FOR ENCODING A SPEECH SIGNAL

[75] Inventors: Masami Akamine; Tadashi Amada, both of Kobe, Japan

[73] Assignee: Kabushiki Kaisha Toshiba, Kawasaki, Japan

[21] Appl. No.: 08/911,719

[22] Filed: Aug. 15, 1997

[30] Foreign Application Priority Data

Aug. 16, 1996 [JP] Japan ..... 8-216319

[51] Int. Cl.[6] ..... G10L 9/14

[52] U.S. Cl. ..... 704/219; 704/223

[58] Field of Search ..... 704/201, 222, 704/200, 219, 220, 223, 230, 221, 229, 207, 228, 216, 225, 262

[56] References Cited

U.S. PATENT DOCUMENTS

| | | | |
|---|---|---|---|
| 4,969,192 | 11/1990 | Chen et al. | 704/200 |
| 5,151,968 | 9/1992 | Tanaka et al. | 704/200 |
| 5,230,036 | 7/1993 | Akamine et al. | 704/200 |
| 5,528,723 | 6/1996 | Gerson et al. | 704/211 |
| 5,553,191 | 9/1996 | Minde | 704/219 |
| 5,625,744 | 4/1997 | Ozawa | 704/222 |
| 5,666,465 | 9/1997 | Ozawa | 704/222 |
| 5,671,327 | 9/1997 | Akamine et al. | 704/219 |
| 5,677,986 | 10/1997 | Amada et al. | 704/222 |
| 5,682,407 | 10/1997 | Fonaki | 374/240 |
| 5,774,838 | 6/1998 | Miseki et al. | 704/222 |

OTHER PUBLICATIONS

M. R. Schroeder, et al., "Code–Excited Linear Prediction (CELP): High–Quality Speech at Very Low Bit Rates", IEEE, 1985, pp. 937–940.

I. A. Gerson, et al., "Techniques for Improving the performance of Celp Type Speech Coders", IEEE, 1991, pp. 205–208.

*Primary Examiner*—Richemond Dorvil

*Attorney, Agent, or Firm*—Oblon Spivak McClelland, Maier & Neustadt, P.C.

[57] ABSTRACT

A speech encoding method including generating a reconstruction speech vector by using a code vector extracted from a codebook storing a plurality of code vectors for encoding a speech signal. In addition an input speech signal to be encoded is used as a target vector to generate an error vector representing the error of the reconstruction speech vector with respect to the target vector, and the error vector is passed through a perceptual weighting filter having a transfer function including the inverse characteristics of the transfer function of a filter for emphasizing the spectrum of a reconstructed speech signal. Thus a weighted error vector is generated, the codebook for a code vector that minimizes the weighted error vector is searched, and an index corresponding to the code vector found as an encoding parameter is output.

20 Claims, 9 Drawing Sheets

SPEECH ENCODING METHOD AND APPARATUS INCLUDING A CODEBOOK STORING A PLURALITY OF CODE VECTORS FOR ENCODING A SPEECH SIGNAL

BACKGROUND OF THE INVENTION

The present invention relates to a speech encoding method and apparatus for encoding speech at a low bit rate.

A speech encoding technique of compression-encoding a speech signal having a telephone band at a low bit rate is indispensable to mobile communication such as a handy-phone in which the usable radio band is limited, and a storage medium such as a voice mail in which the memory must be efficiently used. At present, there is a strong demand for a scheme which realizes a low bit rate and a small encoding delay. As a scheme of encoding a speech signal having the telephone band at a low bit rate of about 4 kbps, a CELP (Code Excited Linear Prediction) scheme is the effective one. This scheme is roughly divided into a process of obtaining the characteristics of a speech synthesis filter prepared by modeling a vocal tract from an input speech signal divided in units of frames, and a process of obtaining a drive signal corresponding to the input signal of the speech synthesis filter.

Of these processes, the latter process of obtaining the drive signal is performed by calculating the distortion of a synthesized speech signal generated by passing a plurality of drive vectors stored in a drive vector codebook through the synthesis filter one by one, i.e., the error signal of the synthesized speech signal with respect to the input speech signal, and searching for a drive vector that minimizes the error signal. This process is called closed-loop search, which is a very effective method for realizing good sound quality at a bit rate of about 8 kbps.

The CELP scheme is described in detail in M. R. Schroeder and B. S. Atal, "Code Excited Linear Prediction (CELP): High Quality Speech at Very Low Bit Rates", Proc. ICASSP, pp. 937–940, 1985, and W. S. Kleijin, D. J. Krasinski et al. "Improved Speech Quality and Efficient Vector Quantization in SELP", Proc. ICASSP, pp. 155–158, 1988.

On the other hand, I. A. Gerson and M. A. Jasiuk: Techniques for improving the performance of CELP type speech coders, IEEE Proc. ICASSP91, pp. 205–208 discloses the arrangement of an improved perceptual weighting filter including a pitch weighting filter.

In this CELP scheme, a drive vector that minimizes distortion arising from undergone perceptual weighting is searched in a closed loop. According to this scheme, good sound quality can be obtained at a bit rate of about 8 kbps. In the CELP scheme, however, the speech signal buffering size necessary in encoding an input speech signal is large, and the processing delay in encoding, i.e., the time required for actually encoding the input speech signal and outputting an encoding parameter is long. More specifically, in the conventional CELP scheme, the input speech signal is divided into frames each having a length of 20 ms to 40 ms, and buffered. An LPC analysis is performed in units of frames, and an LPC coefficient obtained upon this analysis is transmitted. Due to the buffering and the encoding calculation, a processing delay at least twice the frame length, i.e., a delay of 40 ms to 80 ms is generated.

If the delay between transmission and reception increases in a communication system such as a handy-phone, a channel echo, an audio echo, and the like are generated to interrupt telephone conversations. For this reason, a speech encoding scheme which attains a small processing delay is demanded. To decrease the processing delay in speech encoding, the frame length is decreased. However, the decrease in frame length results in a high transmission frequency of LPC coefficients, so the number of quantization bits for the LPC coefficients and drive vectors must be reduced and this degrades the sound quality of the reconstruction speech signal obtained on the decoding side.

To solve the above-described problems of the conventional CELP scheme, a speech encoding scheme which does not transmit any LPC coefficient can be employed. More specifically, a code vector extracted from, e.g., a codebook is used to generate a reconstruction speech signal vector without passing it through a synthesis filter. Using an input speech signal as a target vector, an error vector representing the error of a reconstruction speech signal vector with respect to the target vector is generated. The codebook is searched for a code vector that minimizes the vector obtained by passing the error vector through a perceptual weighting filter. The transfer function of the perceptual weighting filter is set in accordance with an LPC coefficient obtained for the input speech signal.

When no LPC coefficient is transmitted from the encoding side in this manner, how to control the transfer function of a post-filter arranged on the decoding side is important. That is, in the CELP scheme, since good sound quality cannot be obtained in encoding at a bit rate of 4 kbps or less, a post-filter for improving the-subjective quality by spectrum emphasis (formant emphasis) mainly for a reconstruction speech signal must be arranged on the decoding side. In spectrum emphasis, the transfer function of this post-filter is controlled by the LPC coefficient normally supplied from the encoding side. However, when no LPC coefficient is transmitted from the encoding side, as in the above case, the transfer function cannot be controlled.

In the conventional CELP scheme, the LPC coefficient is quantized to attain a least quantization error, in other words, in a closed loop. For this reason, even if the quantization error of the LPC coefficient is minimized, the distortion of the reconstruction speech signal is not always minimized, and decrease in bit rate degrades the quality of the reconstruction speech signal.

As described above, in the speech encoding apparatus of the conventional CELP scheme, a low bit rate and a small delay leads to degradation of the sound quality of the reconstruction speech. If no parameter representing the spectrum envelope of an input speech signal such as an LPC coefficient is transmitted without using any synthesis filter in order to attain a low bit rate and a small delay, the transfer function of the post-filter necessary on the decoding side for a low bit rate cannot be controlled and the sound quality obtained by the post-filter cannot be improved.

BRIEF SUMMARY OF THE INVENTION

It is an object of the present invention to provide a speech encoding method and apparatus capable of decreasing the bit rate and delay and improving the quality of reconstruction speech.

It is an object of the present invention to provide a speech encoding method of changing the transfer function of a perceptual weighting filter on the basis of the inverse characteristics of the transfer function of a spectrum emphasis filter included in a post-filter originally used on the decoding side, or performing spectrum emphasis filtering for an input speech signal before encoding when a reconstruction speech signal vector is generated without using any synthesis filter to encode speech without transmitting any parameter representing the spectrum envelope of the input speech signal.

According to the first aspect of the present invention, there is provided a speech encoding method comprising the steps of preparing a codebook storing a plurality of code vectors for encoding a speech signal, generating a reconstruction speech vector by using the code vector extracted from the codebook, and using an input speech signal to be encoded as a target vector to generate an error vector representing an error of the reconstruction speech vector with respect to the target vector, passing the error vector through a perceptual weighting filter having a transfer function including an inverse characteristic of a transfer function of a filter for emphasizing a spectrum of a reconstruction speech signal, thereby generating a weighted error vector, and searching the codebook for a code vector that minimizes the weighted error vector, and outputting an index corresponding to the code vector found as an encoding parameter.

According to the second aspect of the present invention, there is provided a speech encoding apparatus comprising a codebook storing a plurality of code vectors for encoding a speech signal, a reconstruction speech vector generation unit for generating a reconstruction speech vector by using a code vector extracted from the codebook, an error vector generation unit for generating, using an input speech signal to be encoded as a target vector, an error vector representing an error of the reconstruction speech vector with respect to the target vector, a perceptual weighting filter which has a transfer function including an inverse characteristic of a transfer function of a filter for emphasizing a spectrum of a reconstruction speech signal, and receives the error vector and outputs a weighted error vector, a search unit for searching the codebook for a code vector that minimizes the weighted error vector, and an output unit for outputting an index corresponding to the code vector found by the search unit as an encoding parameter.

According to the third aspect of the present invention, there is provided a speech encoding method comprising the steps of preparing a codebook storing a plurality of code vectors for encoding a speech signal, generating a reconstruction speech vector by using the code vector extracted from the codebook, and using, as a target vector, a speech signal obtained by performing spectrum emphasis for an input speech signal to be encoded, thereby generating an error vector representing an error of the reconstruction speech vector with respect to the target vector, and searching the codebook for a code vector that minimizes a weighted error vector obtained by passing the error vector through a perceptual weighting filter, and outputting an index corresponding to the code vector found as an encoding parameter.

According to the fourth aspect of the present invention, there is provided a speech encoding apparatus comprising a codebook storing a plurality of code vectors for encoding a speech signal, a reconstruction speech vector generation unit for generating a reconstruction speech vector by using a code vector extracted from the codebook, a pre-filter for performing spectrum emphasis for an input speech signal to be encoded, an error vector generation unit for generating, using a speech signal having undergone spectrum emphasis by the pre-filter as a target vector, an error vector representing an error of the reconstruction speech vector with respect to the target vector, a perceptual weighting filter for receiving the error vector and outputting a weighted error vector, a search unit for searching the codebook for a code vector that minimizes the weighted error vector, and an output unit for outputting an index corresponding to the code vector found by the search unit as an encoding parameter.

With this arrangement, according to the present invention, while a low bit rate and a small delay are attained, the quality of reconstruction speech can be improved. In the conventional CELP scheme, the LPC coefficient must be transmitted as part of an encoding parameter. Accordingly, the sound quality suffers with decreases in encoding bit rate and delay. In the conventional CELP scheme, the LPC coefficient is used to remove the short-term correlation of a speech signal. In the present invention, the correlation of the speech signal is removed using a vector quantization technique without transmitting any LPC coefficient. In this manner, since the LPC coefficient need not be transferred to the decoding side, and is used only for setting the transfer functions of a perceptual weighting filter and a pre-filter, the frame length in encoding can be shortened to reduce the processing delay.

In the present invention, of the functions of a post-filter normally arranged on the decoding side, particularly the function of spectrum emphasis requiring a parameter representing the spectrum envelope, such as an LPC coefficient, is given to the perceptual weighting filter. Alternatively, spectrum emphasis is performed by the pre-filter before encoding. Although no parameter required for the processing of the post-filter is transmitted, a good sound quality can be obtained even at a low bit rate. On the decoding side, since the post-filter is eliminated, or the post-filter does not include spectrum emphasis or is simplified to perform only slight spectrum emphasis, the calculation amount required for filtering is reduced.

In the present invention, an input speech signal is used as a target vector, the error vector of a reconstruction speech signal vector is processed by the perceptual weighting filter, and a codebook for vector quantization is searched for a code vector for attaining a least weighted error. With this processing, the codebook can be searched in a closed loop while the effect of the LPC coefficient conventionally encoded in an open loop is exploited. An improvement in sound quality can be expected at the subjective level.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
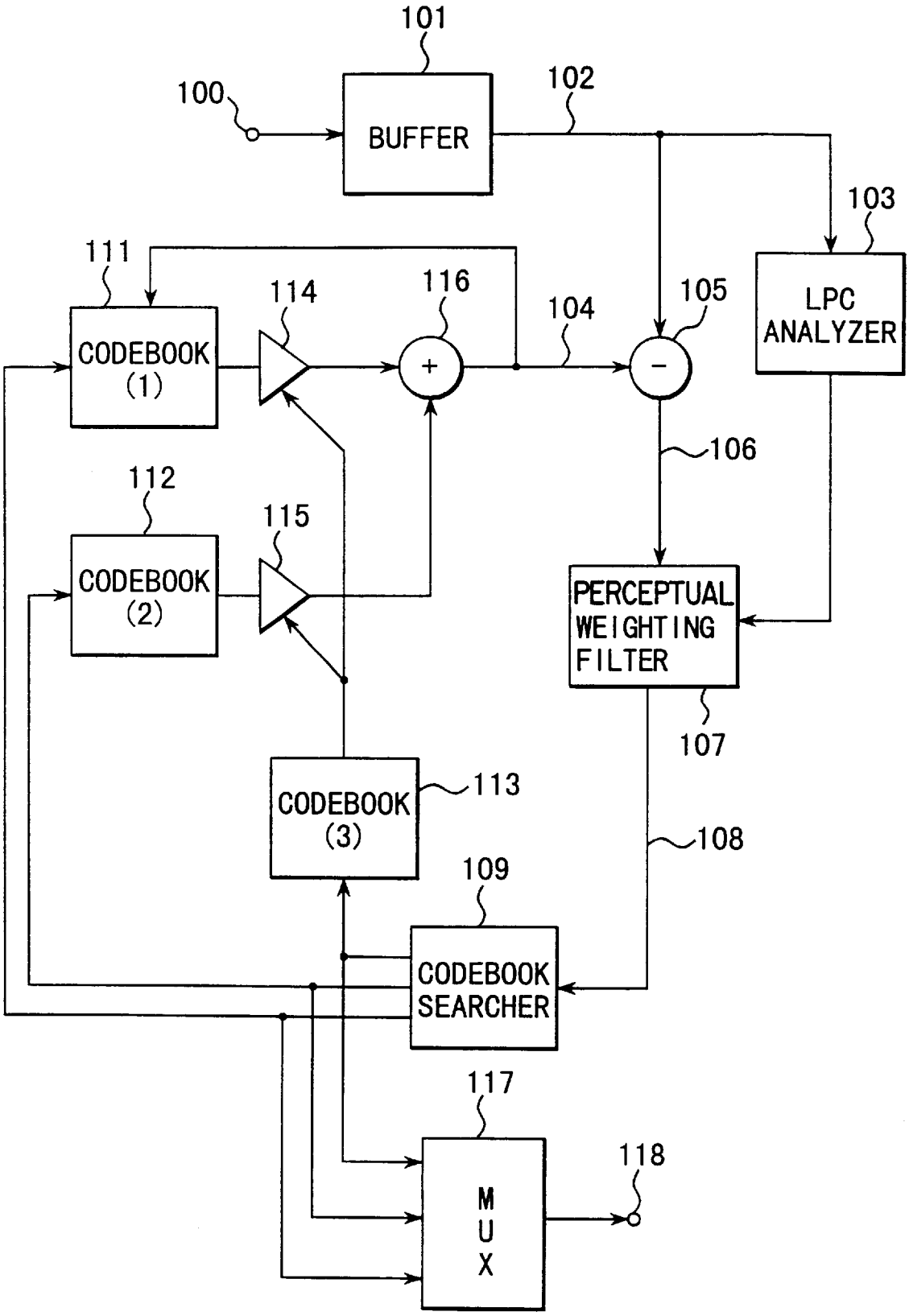
FIG. 1 is a block diagram showing the arrangement of a speech encoding apparatus according to the first embodiment.

FIG. 1 is a block diagram showing the arrangement of a speech encoding apparatus according to the first embodiment of the present invention. This speech encoding apparatus is constituted by a buffer 101, an LPC analyzer 103, a subtracter 105, a perceptual weighting filter 107, a codebook searcher 109, first, second, and third codebooks 111, 112, and 113, gain multipliers 114 and 115, an adder 116, and a multiplexer 117.

An input speech signal from an input terminal 100 is temporarily stored in the buffer 101. The LPC analyzer 103 performs an LPC analysis (linear prediction analysis) for the input speech signal via the buffer 101 in units of frames to output an LPC coefficient as a parameter representing the spectrum envelope of the input speech signal. The subtracter 105 uses the input speech signal output from the buffer 101 as a target vector 102, and subtracts a reconstruction speech signal vector 104 from the target vector 102 to output an error vector 106 to the perceptual weighting filter 107. To audibly improve the subjective sound quality of the reconstruction speech signal in accordance with an LPC coefficient obtained by the LPC analyzer 103, the perceptual weighting filter 107 differently weights the error vector 106 for each frequency to output a weighted error vector 108 to the codebook searcher 109. Upon reception of the weighted error vector 108, the codebook searcher 109 searches the first, second, and third codebooks 111, 112, and 113 for code vectors that minimize the distortion (error) of the reconstruction speech signal. The multiplexer 117 converts the indexes of the code vectors searched from the codebooks 111, 112, and 113 into a code sequence, and multiplexes and outputs it as an encoding parameter to an output terminal 118.

The first and second codebooks 111 and 112 are respectively used to remove the long-term and short-term correlations of speech by using a vector quantization technique, whereas the third codebook 113 is used to quantize the gain of the code vector.

The speech encoding apparatus of this embodiment is greatly different from the speech encoding apparatus of the conventional CELP scheme in that no synthesis filter is used.

Figure 2:
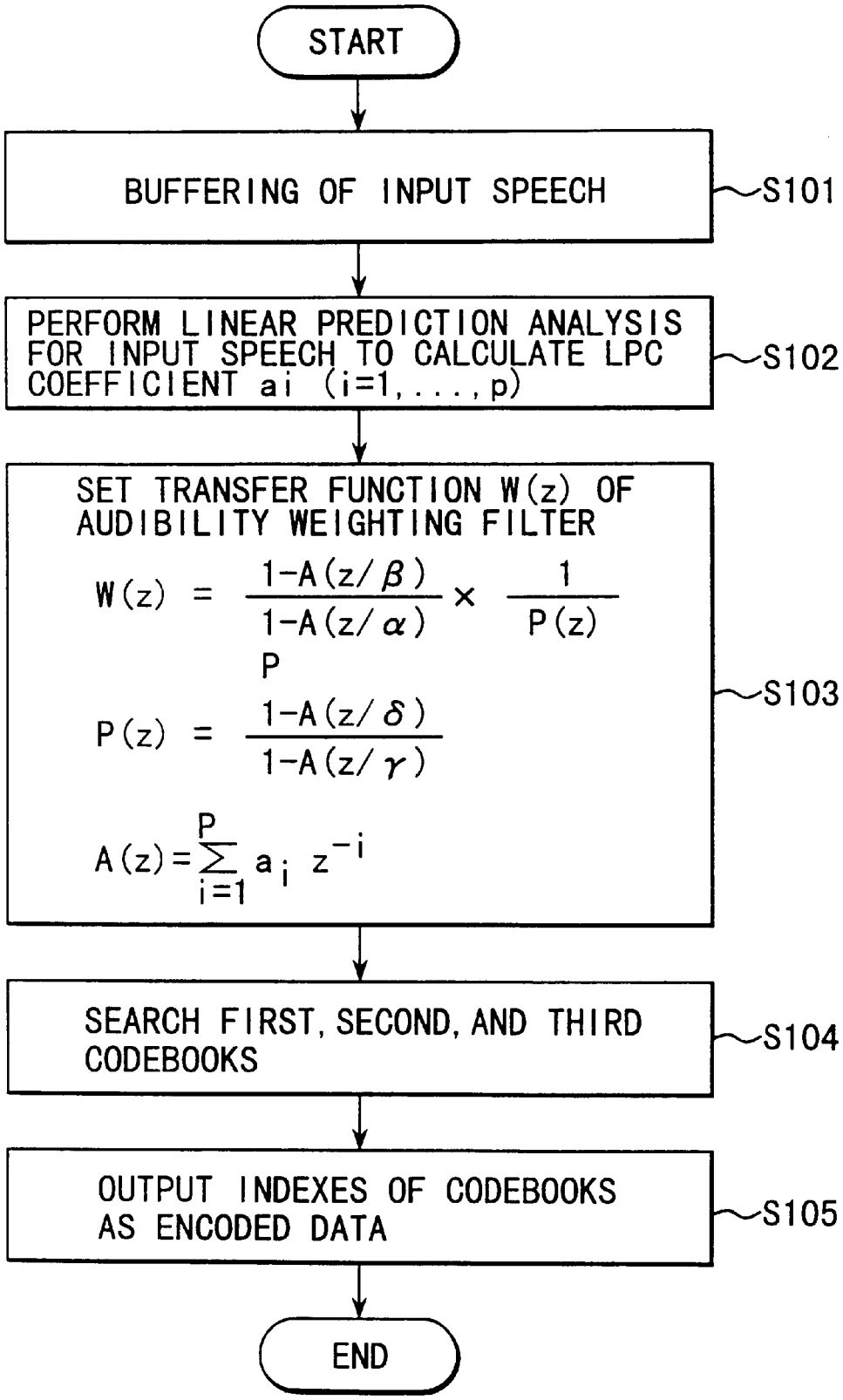
FIG. 2 is a flow chart showing the encoding procedure of the speech encoding apparatus according to the first embodiment.

The encoding procedure of the speech encoding apparatus according to this embodiment will be described below with reference to a flow chart in FIG. 2.

First, an input digitized speech signal is input from the input terminal 100, divided into sections called frames which have a predetermined interval, and stored in the buffer 101 (step S101). The input speech signal is input to the LPC analyzer 103 via the buffer 101 in units of frames, and subjected to a linear prediction analysis (LPC analysis) to calculate an LPC coefficient ai (i=1, . . . , p) as a parameter representing the spectrum envelope of the input speech signal (step S102). This LPC analysis is performed not to transmit the LPC coefficient, unlike the conventional CELP scheme, but to shape the noise spectrum at the perceptual weighting filter 107 and give the inverse characteristics of spectrum emphasis to the perceptual weighting filter 107. The frame length serving as the unit of the LPC analysis can be set independently of the frame length serving as the unit of encoding.

In this manner, no LPC coefficient need be transferred from the speech encoding apparatus for speech decoding. Therefore, the frame length serving as the unit of encoding can be set smaller than the frame length (20 to 40 ms) of the conventional CELP scheme, and suffices to be, e.g., 5 to 10 ms. That is, since no LPC coefficient is transmitted, a decrease in frame length does not degrade the quality of the reconstruction speech, unlike in the conventional scheme. As the LPC analysis method, a known method such as an auto-correlation method can be employed. The LPC coefficient obtained in this manner is applied to the perceptual weighting filter 107 to set its transfer function W(z), as will be described later (step S103).

Subsequently, the input speech signal is encoded in units of frames. In encoding, the first, second, and third codebooks 111, 112, and 113 are sequentially searched by the codebook searcher 109 to achieve minimum distortion (to be described later), and the respective indexes are converted into a code sequence, which is multiplexed by the multiplexer 117 (steps S104 and S105). The speech encoding apparatus of this embodiment divides the redundancy (correlation) of the speech signal into a long-term correlation based on the periodic component (pitch) of speech and a short-term correlation related to the spectrum envelope of speech, and removes them to compress the redundancy. The first codebook 111 is used to remove the long-term correlation, while the second codebook 112 is used to remove the short-term correlation. The third codebook 113 is used to encode the gains of code vectors output from the first and second codebooks 111 and 112.

Search processing of the first codebook 111 will be described. Prior to the search, the transfer function W(z) of the perceptual weighting filter 107 is set in accordance with the following equation:

$$W(z) = \frac{1 - A(z/\alpha)}{1 - A(z/\beta)} \times \frac{1}{P(z)} \tag{1}$$

$$P(z) = \frac{1 - A(z/\delta)}{1 - A(z/\gamma)} \tag{2}$$

$$A(z) = \sum_{i=1}^{P} a_i z^{-i} \tag{3}$$

where P(z) is the transfer function of the conventional post-filter. More specifically, P(z) may be, e.g., the transfer function of a spectrum emphasis filter (formant emphasis filter), or include the transfer function of a pitch emphasis filter or a high frequency band emphasis filter.

If the transfer function W(z) of the perceptual weighting filter 107 combines the transfer characteristics (the first term of the right-hand side of equation (1)) of the perceptual weighting filter, and the inverse characteristics (the second term of the right-hand side of equation (1)) of the transfer function of the post-filter in this manner, the noise spectrum can be shaped into the spectrum envelope of the input speech signal, and the spectrum of the reconstruction speech signal can be emphasized, similar to the conventional post-filter. $\alpha$, $\beta$, $\gamma$, and $\delta$ are constants for controlling the degree of noise shaping, and are experimentally determined. The typical values of $\alpha$ and $\gamma$ are 0.7 to 0.9, whereas those of $\beta$ and $\delta$ are 0.5.

The first codebook 111 is used to express the periodic component (pitch) of the speech. As given by the following equation, a code vector e(n) stored in the codebook 111 is formed by extracting a past reconstruction speech signal corresponding to one frame length:

$$e(n)=e(n-L),\ n=1,\ \mathrm{N} \tag{4}$$

where L is the lag, and N is the frame length.

The codebook searcher 109 searches the first codebook 111. In the codebook searcher 109, the first codebook 111 is searched by finding a lag that minimizes the distortion obtained by passing the target vector 102 and the code vector e through the perceptual weighting filter 107. The lag sample may have an integral or decimal unit.

The codebook searcher 109 searches the second codebook 112. In this case, the subtracter 105 subtracts the code vector of the first codebook 111 from the target vector 102 to obtain a new target vector. Similar to the search of the first codebook 111, the second codebook 112 is searched to attain minimum weighted distortion (error) of the code vector of the second codebook 112 with respect to the target vector 102. That is, the subtracter 105 calculates, as the error signal vector 106, the error of the code vector 104 output from the second codebook 112 via the gain multiplier 114 and the adder 116 with respect to the target vector 102. The codebook 112 is searched for a code vector that minimizes the vector obtained by passing the error signal vector 106 through the perceptual weighting filter 107. The search of the second codebook 112 is similar to the search of a stochastic codebook in the CELP scheme. In this case, a known technique such as a structured codebook such as a vector sum, backward filtering, or preliminary selection can be employed in order to reduce the calculation amount required to search the second codebook 112.

The codebook searcher 109 searches the third codebook 113. The third codebook 113 stores a code vector having, as an element, a gain by which code vectors stored in the first and second codebooks 111 and 112 are to be multiplied. The third codebook 113 is searched for an optimal code vector by a known method to achieve minimum weighted distortion (error), with respect to the target vector 102, of the reconstruction speech signal vector 104 obtained by multiplying the code vectors extracted from the first and second codebooks 111 and 112 by gains by the gain multipliers 114 and 115, and adding them by the adder 116.

The codebook searcher 109 outputs, to the multiplexer 117, indexes corresponding to the code vectors found in the first, second, and third codebooks 111, 112, and 113. The multiplexer 117 converts the three input indexes into a code sequence, and multiplexes and outputs it as an encoding parameter to the output terminal 118. The encoding parameter output to the output terminal 118 is transmitted to a speech decoding apparatus (to be described later) via a transmission path or a storage medium (neither are shown).

After the gain multipliers 114 and 115 multiply the code vectors corresponding to the indexes of the first and second codebooks 111 and 112 obtained by the codebook searcher 109 by a gain corresponding to the index of the third codebook 113 similarly obtained by the codebook searcher 109, the adder 116 adds them to attain a reconstruction speech signal vector 104. When the contents of the first codebook 111 are updated on the basis of the reconstruction speech signal vector 104, the speech encoding apparatus waits for the input of a speech signal of a next frame to the input terminal 100.

Figure 3:
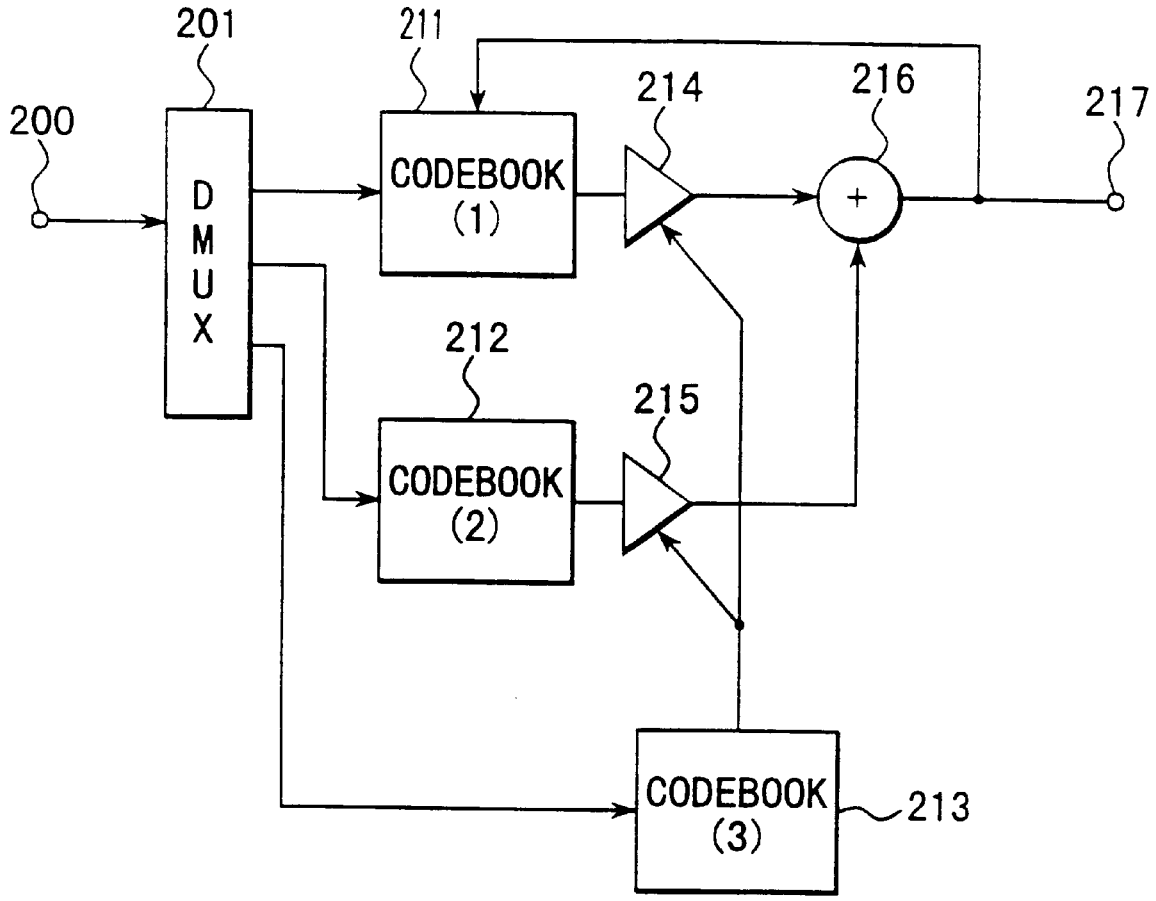
FIG. 3 is a block diagram showing the arrangement of a speech decoding apparatus according to the first embodiment.

A speech decoding apparatus according to the first embodiment corresponding to the speech encoding apparatus in FIG. 1 will be described with reference to FIG. 3.

This speech decoding apparatus is constituted by a demultiplexer 201, first, second, and third codebooks 211, 212, and 213, gain multipliers 214 and 215, and an adder 216. The first, second, and third codebooks 211, 212, and 213 respectively store the same code vectors as those stored in the first, second, and third codebooks 111, 112, and 113 in FIG. 1.

The encoding parameter output from the speech encoding apparatus shown in FIG. 1 is input to an input terminal 200 via the transmission path or the storage medium (neither are shown). This encoding parameter is input to the demultiplexer 201, and three indexes corresponding to the code vectors found in the codebooks 111, 112, and 113 in FIG. 1 are separated. Thereafter, the parameter is supplied to the codebooks 211, 212, and 213. With this processing, the same code vectors as those found in the codebooks 111, 112, and 113 can be extracted from the codebooks 211, 212, and 213.

After the gain multipliers 214 and 215 multiply the code vectors extracted from the first and second codebooks 211 and 212 by a gain represented by the code vector from the third codebook 213, the adder 216 adds them to output a reconstruction speech signal vector from an output terminal 217. When the contents of the first codebook 211 are updated on the basis of the reconstruction speech signal vector, the speech decoding apparatus waits for the input of an encoding parameter of a next frame to the input terminal 200.

In a speech decoding apparatus based on the conventional CELP scheme, a signal output from the adder 216 is input as a drive signal to a synthesis filter having transfer characteristics determined by the LPC coefficient. When the encoding bit rate is as low as 4 kbps or less, a reconstruction speech signal output from the synthesis filter is output via a post-filter.

In this embodiment, since the synthesis filter is eliminated on the speech encoding apparatus side shown in FIG. 1, the synthesis filter is also eliminated on the speech decoding apparatus. Since the processing of the post-filter is performed by the perceptual weighting filter 107 inside the speech encoding apparatus in FIG. 1, the need for the post-filter is obviated in the speech decoding apparatus in FIG. 3.

Figure 4:
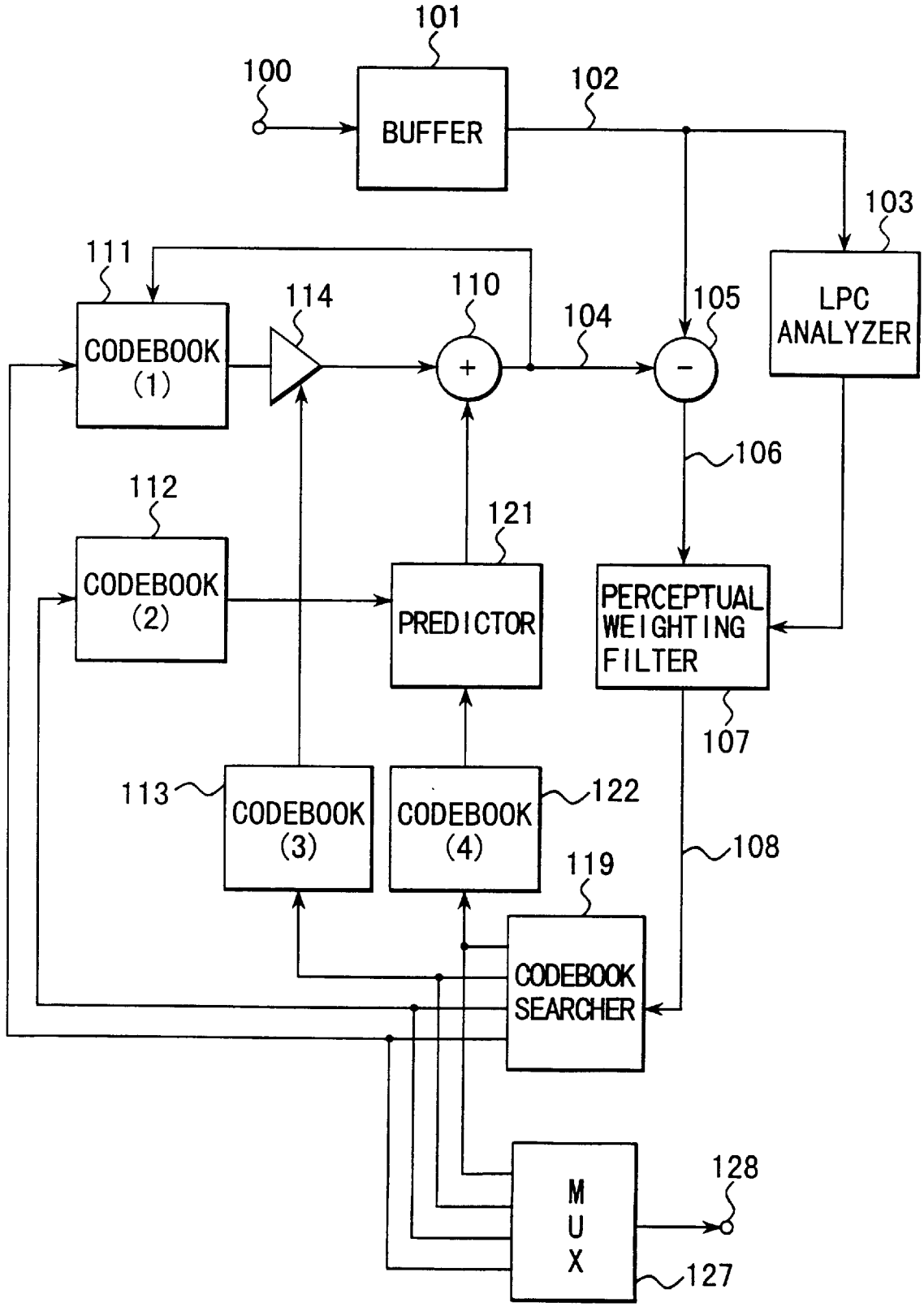
FIG. 4 is a block diagram showing the arrangement of a speech encoding apparatus according to the second embodiment.

FIG. 4 is a block diagram showing the arrangement of a speech encoding apparatus according to the second embodiment of the present invention. The second embodiment is different from the first embodiment in that a predictor 121 is arranged to remove the correlation between code vectors stored in a second codebook 112, and a fourth codebook 122 for controlling the predictor 121 is added.

Figure 5:
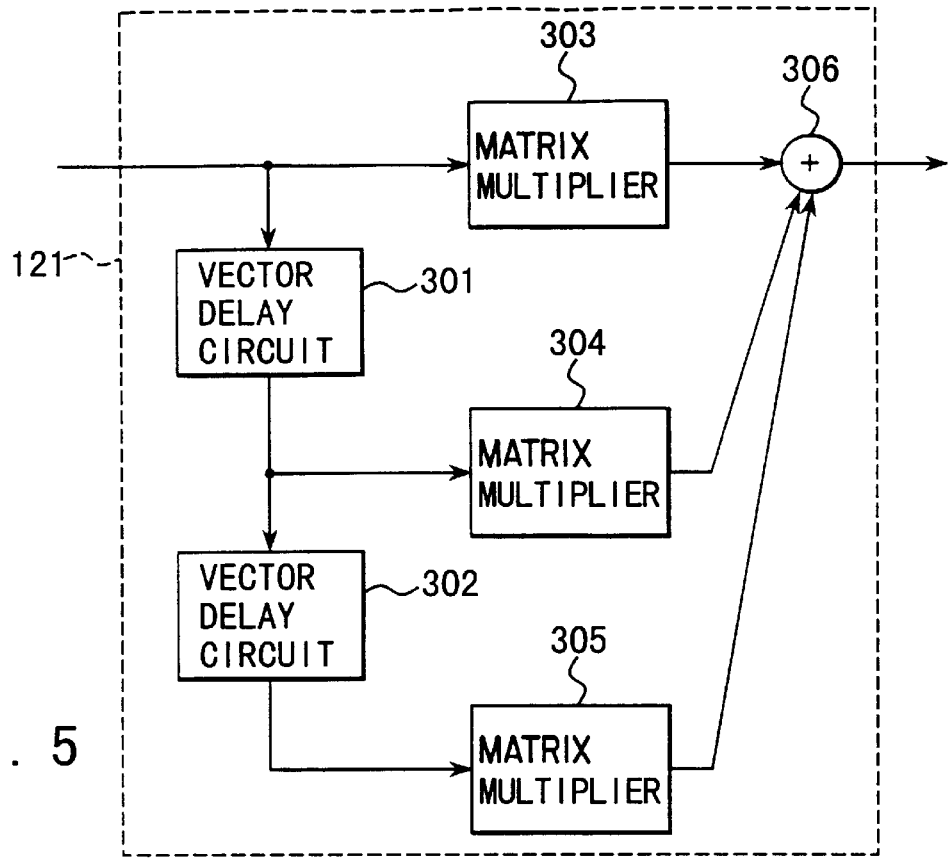
FIG. 5 is a block diagram showing the arrangement of a predictor.

FIG. 5 is a block diagram showing the arrangement of an MA predictor as a detailed example of the predictor 121. This predictor is constituted by vector delay circuits 301 and 302 for generating a delay corresponding to one vector, matrix multipliers 303, 304, and 305, and an adder 306. The first matrix multiplier 303 receives an input vector of the predictor 121, the second matrix multiplier 304 receives an output vector from the first vector delay circuit 301, and the third matrix multiplier 305 receives an output vector from the second vector delay circuit 302. Output vectors from the matrix multipliers 303, 304, and 305 are added by the adder 306 to generate an output vector of the predictor 121.

If X and Y represent the input and output vectors of the predictor 121, and A0, A1, and A2 represent the coefficient matrixes by which input vectors in the matrix multipliers 303, 304, and 305 are to be multiplied, then the operation of the predictor 121 is given by the following equation:

$$Yn=A0*Xn+A1*Xn-1+A2*Xn-2 \quad (5)$$

where Xn−1 is the vector prepared by delaying Xn by one vector, and Xn−2 is the vector prepared by delaying Xn−1 by one vector. The coefficient matrixes A0, A1, and A2 are obtained in advance by a known learning method, and stored as code vectors in the fourth codebook 122.

The operation of the second embodiment will be explained below mainly about the difference from the first embodiment.

The LPC analysis of an input speech signal in units of frames, and setting of the transfer function of a perceptual weighting filter 107 are performed similar to the first embodiment. A codebook searcher 119 searches for a first codebook 111, similar to the first embodiment.

The second codebook 112 is searched by the codebook searcher 119 by inputting a code vector extracted from the second codebook 112 to the predictor 121 to generate a prediction vector, and searching the second codebook 112 for a code vector that minimizes the weighted distortion between this prediction vector and a target vector 102. The prediction vector is calculated in accordance with equation (5) using the coefficient matrixes A0, A1, and A2 given as code vectors from the fourth codebook 122. The search of the second codebook 112 is performed for all code vectors stored in the fourth codebook 122. Therefore, the second codebook 112 and the fourth codebook 122 are simultaneously searched.

Since the fourth codebook 122 is arranged in addition to the first, second, and third codebooks 111, 112, and 113, a multiplexer 127 converts four indexes from the first, second, and third codebooks 111, 112, and 113, and the fourth codebook 122 into a code sequence, and multiplexes and outputs it as an encoding parameter to an output terminal 128.

Figure 6:
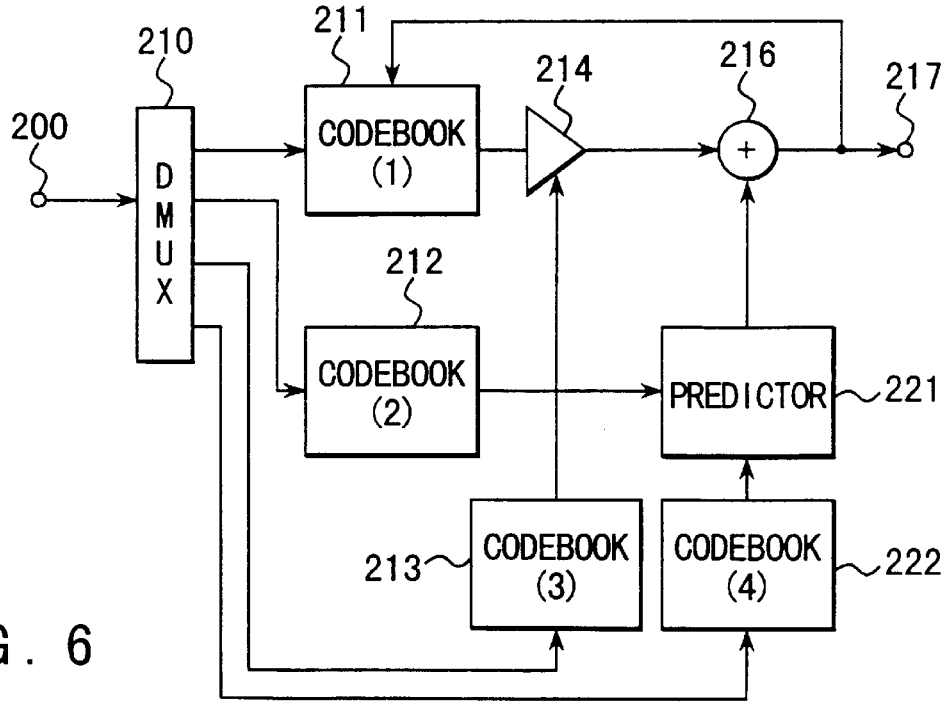
FIG. 6 is a block diagram showing the arrangement of a speech decoding apparatus according to the second embodiment.

FIG. 6 is a block diagram showing the arrangement of a speech decoding apparatus corresponding to the speech encoding apparatus in FIG. 4. This speech decoding apparatus is different from the speech decoding apparatus of the first embodiment shown in FIG. 3 in that a predictor 221 is arranged in correspondence with the speech encoding apparatus in FIG. 4 to remove the correlation between code vectors stored in a second codebook 212, and a fourth codebook 222 is added as a codebook for the predictor 221. The predictor 221 has the same arrangement as that of the predictor 121 in the encoding apparatus, and is constituted as shown in, e.g., FIG. 5.

The encoding parameter output from the speech encoding apparatus shown in FIG. 4 is input to the input terminal 200 via a transmission path or a storage medium (neither are shown). This encoding parameter is input to a demultiplexer 210, and four indexes corresponding to the code vectors found in the codebooks 111, 112, 113, and 121 in FIG. 4 are separated. Thereafter, the parameter is supplied to codebooks 211, 212, and 213 and the codebook 222. With this processing, the same code vectors as those found in the codebooks 111, 112, 113, and 122 can be extracted from the codebooks 211, 212, 213, and 222. The code vector from the first codebook 211 is multiplied by a gain multiplier 214 by a gain represented by the code vector from the third codebook 213, and then input to an adder 216. The code vector from the second codebook 212 is input to the predictor 221 to generate a prediction vector. This prediction vector is input to the adder 216, and added with the code vector from the first codebook 211 which is multiplied by the gain by the gain multiplier 214, thereby outputting a reconstruction speech signal from an output terminal 217.

In the first and second embodiments, the spectrum of the reconstruction speech signal is emphasized by controlling the transfer function of the perceptual weighting filter 107 on the basis of the inverse characteristics of the transfer function of the post-filter. The spectrum of the reconstruction speech signal can also be emphasized by performing spectrum emphasis filtering for the input speech signal before encoding.

Figure 7:
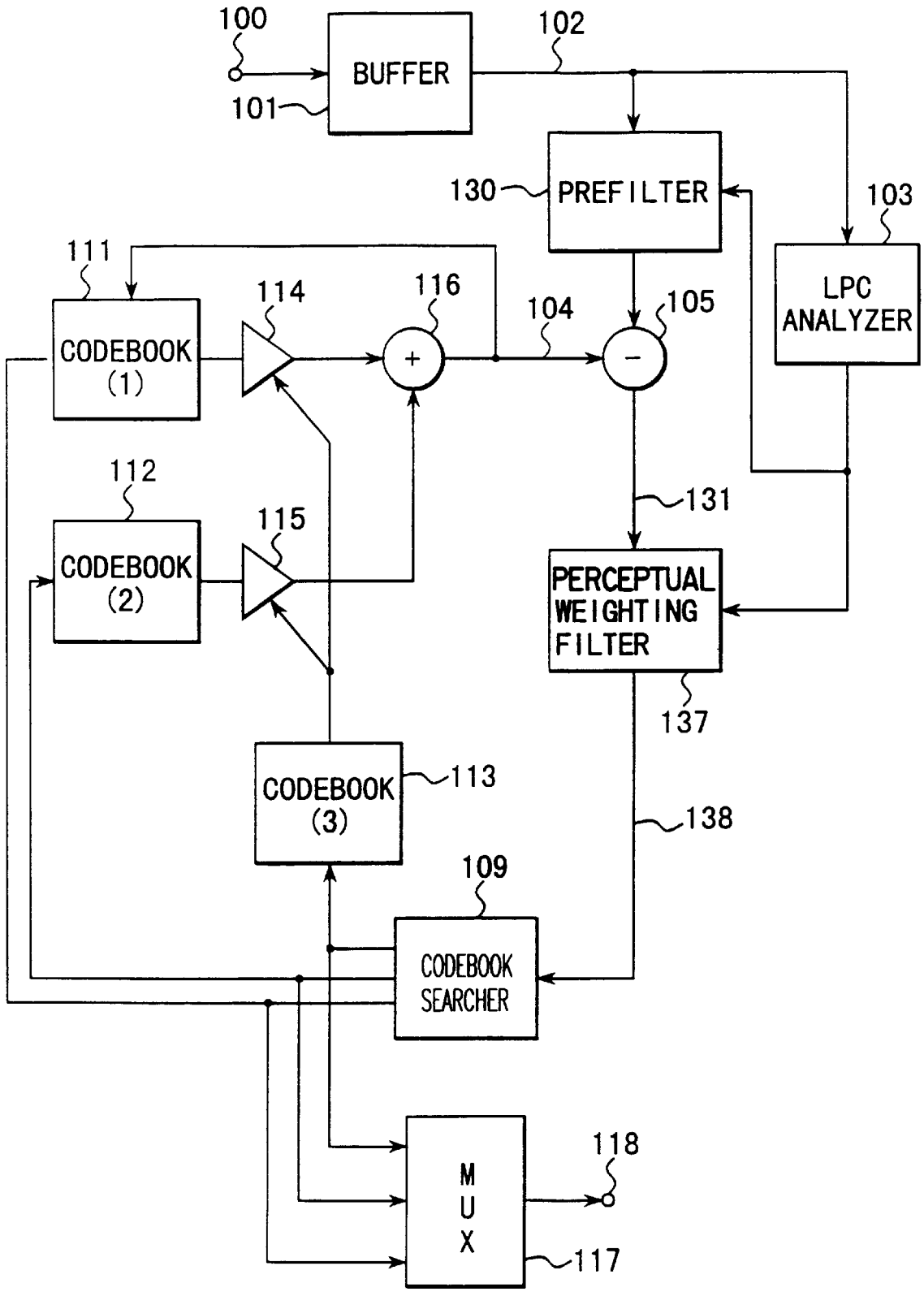
FIG. 7 is a block diagram showing the arrangement of a speech encoding apparatus according to the third embodiment.

FIG. 7 is a block diagram showing the arrangement of a speech encoding apparatus according to the third embodiment based on this method. The third embodiment is different from the first embodiment in that a pre-filter 130 is arranged on the output stage of a buffer 101, and the transfer function of a perceptual weighting filter 137 is changed not to include the characteristics of the post-filter.

Figure 8:
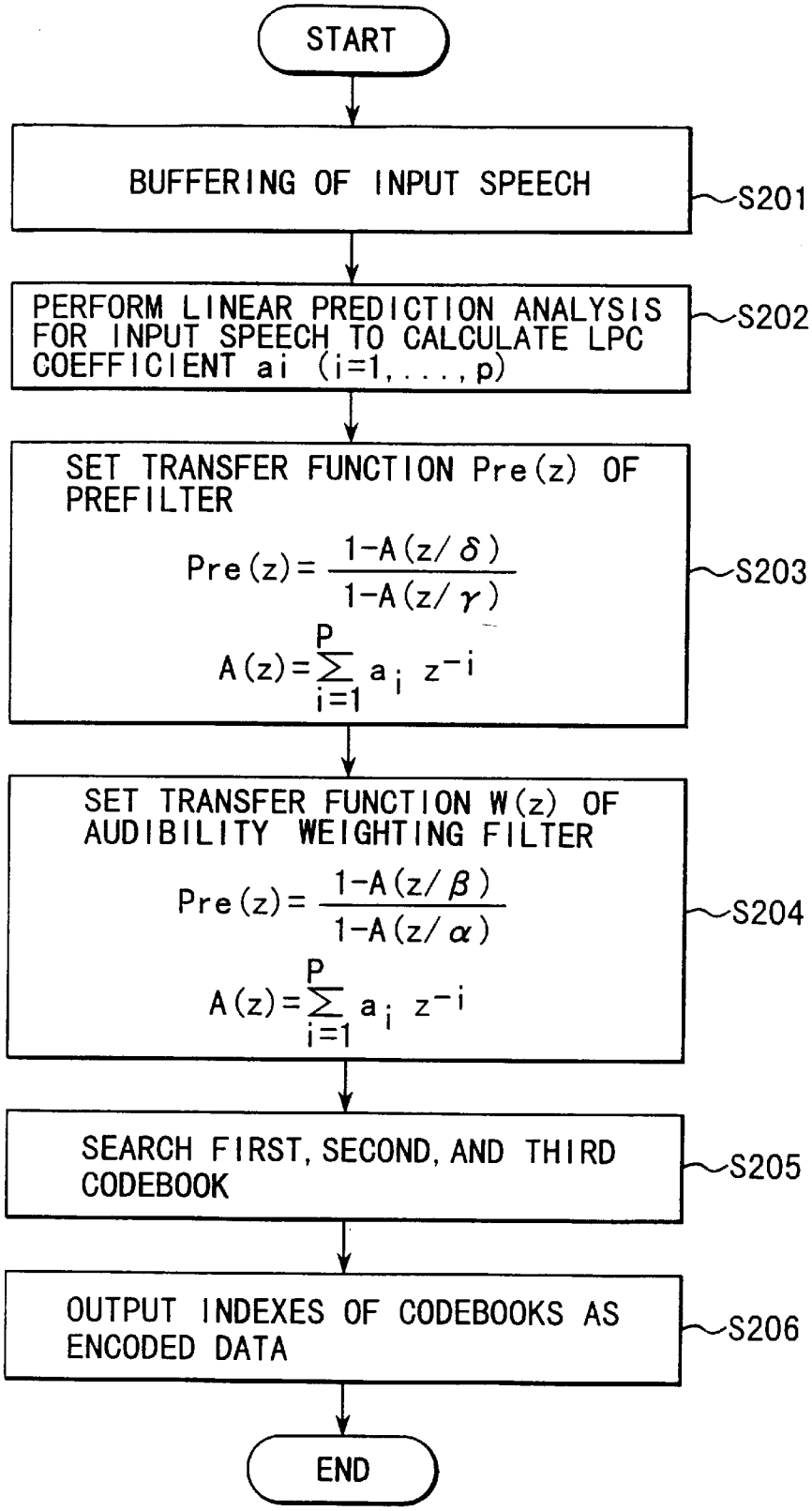
FIG. 8 is a flow chart showing the encoding procedure of the speech encoding apparatus according to the third embodiment.

The encoding procedure of the speech encoding apparatus according to the third embodiment will be described below with reference to a flow chart shown in FIG. 8.

First, an input digital speech signal is input from an input terminal 100, divided into sections called frames which have a predetermined interval, and stored in a buffer 101 (step S201). The input speech signal is input to an LPC analyzer 103 via the buffer 101 in units of frames, and subjected to a linear prediction analysis (LPC analysis) to calculate an LPC coefficient ai (i=1, . . . , p) as a parameter representing the spectrum envelope of the input speech signal (step S202). This LPC analysis is performed not to transmit the LPC coefficient, unlike the conventional CELP scheme, but to emphasize the spectrum at the pre-filter 130 and shape the noise spectrum at the perceptual weighting filter 137. As the LPC analysis method, a known method such as an autocorrelation method can be used. The LPC coefficient is applied to the pre-filter 130 and the perceptual weighting filter 137 to set the transfer function Pre(z) of the pre-filter 130 and the transfer function W(z) of the perceptual weighting filter 137 (steps S203 and S204).

Next, the input speech signal is encoded in units of frames. In encoding, first, second, and third codebooks 111, 112, and 113 are sequentially searched by a codebook searcher 109 to obtain minimum distortion (to be described later), and the respective indexes are converted into a code sequence, which is multiplexed by a multiplexer 117 (steps S205 and S206).

The speech encoding apparatus of this embodiment divides the redundancy (correlation) of the speech signal into a long-term correlation based on the periodic component (pitch) of the speech and a short-term correlation related to the spectrum envelope of the speech, and removes them to compress the redundancy. The first codebook 111 is used to remove the long-term correlation, while the second codebook 112 is used to remove the short-term correlation. The third codebook 113 is used to encode the gains of code vectors output from the first and second codebooks 111 and 112.

Search processing of the first codebook 111 will be described. Prior to the search, the transfer function Pre (z) of the pre-filter 130 and the transfer function W(z) of the perceptual weighting filter 137 are set in accordance with the following equation:

$$Pre(z) = \frac{1 - A(z/\delta)}{1 - A(z/\gamma)} \quad (6)$$

$$W(z) = \frac{1 - A(z/\alpha)}{1 - A(z/\beta)} \quad (7)$$

$$A(z) = \sum_{i=1}^{P} a_i z^{-i} \quad (8)$$

where $\gamma$ and $\delta$ are constants for controlling the degree of spectrum emphasis, and $\alpha$ and $\beta$ are constants for controlling the degree of noise shaping, which are experimentally determined. In this embodiment, the transfer function W(z) of the perceptual weighting filter 137 is the transfer characteristics of the perceptual weighting filter. If a filter for performing spectrum emphasis is arranged as the pre-filter 130, the noise spectrum can be shaped into the spectrum envelope of the input speech signal by the perceptual weighting filter 137, and the spectrum of the reconstruction speech signal can be emphasized by the pre-filter 130.

The first codebook 111 is used to express the periodic component (pitch) of the speech. As given by equation (7), a code vector e(n) stored in the codebook 111 is formed by extracting a past reconstruction speech signal corresponding to one frame length.

The codebook searcher 109 searches the first codebook 111. In the codebook searcher 109, the first codebook 111 is searched by finding a lag that minimizes distortion obtained by passing a target vector 102 and the code vector e through the perceptual weighting filter 137. The lag sample may have an integral or decimal unit.

The codebook searcher 109 searches the second codebook 112. In this case, a subtracter 105 subtracts the code vector of the first codebook 111 from the target vector 102 to obtain a new target vector. Similar to the search of the first codebook 111, the second codebook 112 is searched to minimize the weighted distortion (error) of the code vector of the second codebook 112 with respect to the target vector 102. That is, the subtracter 105 calculates, as an error signal vector 106, the error of a code vector 104 output from the second codebook 112 via a gain multiplier 114 and an adder 116 with respect to the target vector 102. The codebook 112 is searched for a code vector that minimizes the vector obtained by passing the error signal vector 106 through the perceptual weighting filter 107. The search of the second codebook 112 is similar to the search of a stochastic codebook in the CELP scheme. In this case, a known technique such as a structured codebook such as a vector sum, backward filtering, or preliminary selection can also be employed in order to reduce the calculation amount required to search the second codebook 112.

The codebook searcher 109 searches the third codebook 113. The third codebook 113 stores a code vector having, as an element, a gain by which code vectors stored in the first and second codebooks 111 and 112 are to be multiplied. The third codebook 113 is searched for an optimal code vector by a known method to minimize the weighted distortion (error), with respect to the target vector 102, of the reconstruction speech signal vector 104 obtained by multiplying the code vectors extracted from the first and second codebooks 111 and 112 by gains by the gain multipliers 114 and 115, and adding them by the adder 116.

The codebook searcher 109 outputs, to the multiplexer 117, indexes corresponding to the code vectors found in the first, second, and third codebooks 111, 112, and 113. The multiplexer 117 converts the three input indexes into a code sequence, and outputs it as an encoding parameter to the output terminal 118. The encoding parameter output to the output terminal 118 is transmitted to a speech decoding apparatus (to be described later) via a transmission path or a storage medium (neither are shown).

After the gain multipliers 114 and 115 multiply the code vectors corresponding to the indexes of the first and second codebooks 111 and 112 obtained by the codebook searcher 109 by a gain corresponding to the index of the third codebook 113 similarly obtained by the codebook searcher 109, the adder 116 adds the results to attain a reconstruction speech signal vector. When the contents of the first codebook 111 are updated on the basis of the reconstruction speech signal vector 104, the speech encoding apparatus waits for the input of a speech signal of a next frame to the input terminal 100.

Figure 9:
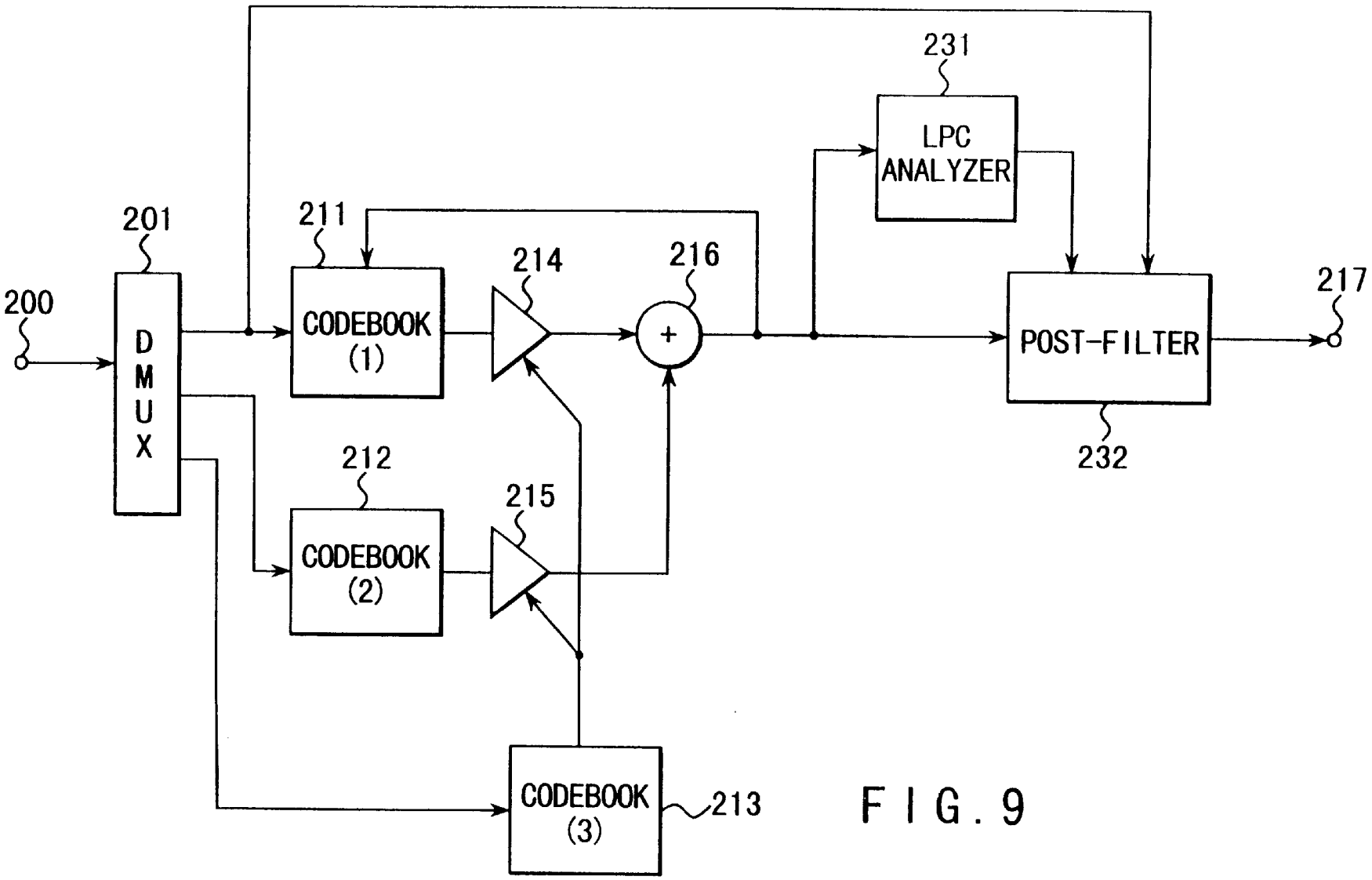
FIG. 9 is a block diagram showing the arrangement of a speech decoding apparatus according to the third embodiment.

FIG. 9 is a block diagram showing the arrangement of a speech decoding apparatus according to the third embodiment of the present invention. In the speech decoding apparatus of this embodiment, an LPC analyzer 231 and a post-filter 232 are added on the output side of an adder 216 in the speech decoding apparatus of the first embodiment shown in FIG. 3. The LPC analyzer 231 performs an LPC analysis for the reconstruction speech signal to obtain an LPC coefficient. The post-filter 232 performs spectrum emphasis with a spectrum emphasis filter having a transfer function set based on the LPC coefficient. The post-filter 232 obtains pitch information on the basis of an index input from a demultiplexer 201 to a first codebook 211, and performs pitch emphasis with a pitch emphasis filter having a transfer function set based on the pitch information, as needed.

In the speech encoding apparatus of the first embodiment shown in FIG. 1, the transfer function of the perceptual weighting filter 107 includes the inverse characteristics of the transfer function of the post-filter. For this reason, in the speech encoding apparatus, of the processing of the post-filter, part of spectrum emphasis processing is performed in effect. In the post-filter 232 of the speech decoding apparatus in FIG. 9, therefore, at least the spectrum emphasis is greatly simplified, and the calculation amount required for the processing is very small.

In FIG. 9, the LPC analyzer 231 may be eliminated, and the post-filter 232 may perform only filtering such as pitch emphasis except for spectrum emphasis.

Figure 10:
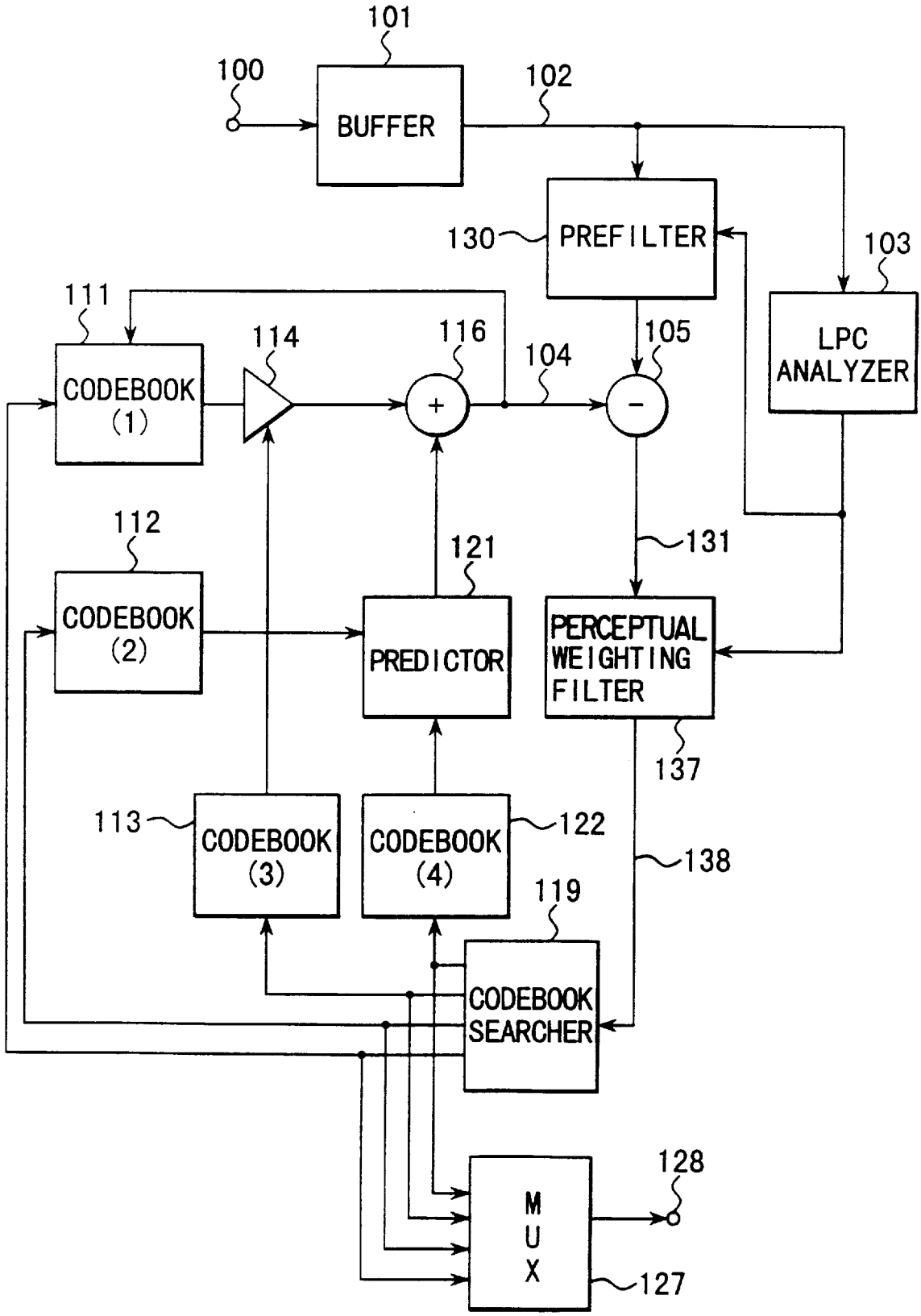
FIG. 10 is a block diagram showing the arrangement of a speech encoding apparatus according to the fourth embodiment.

FIG. 10 is a block diagram showing the arrangement of a speech encoding apparatus according to the fourth embodiment. The fourth embodiment is different from the second embodiment, shown in FIG. 4, in that a pre-filter 130 is arranged on the output stage of a buffer 101.

As has been described above, according to the present invention, the correlation of a speech signal is removed using a vector quantization technique, and no parameter representing the spectrum envelope of an input speech signal, such as an LPC coefficient, is transferred. As a result, the frame length used in analyzing an input speech signal for parameter extraction can be shortened to reduce the delay time due to buffering for the analysis.

Of the functions of the post-filter, the function of spectrum emphasis requiring a parameter representing the spectrum envelope is given to the perceptual weighting filter. Alternatively, spectrum emphasis is performed by the pre-filter before encoding. Accordingly, good sound quality can be obtained even at a low bit rate. On the decoding side, since the post-filter is eliminated, or the post-filter does not include spectrum emphasis or is simplified to perform only slight spectrum emphasis, the calculation amount required for filtering is reduced.

An input speech signal is used as a target vector, the error vector of a reconstruction speech signal vector is processed by the perceptual weighting filter, and the codebook for vector quantization is searched for a code vector that minimizes the weighted error. With this processing, the codebook can be searched in a closed loop while the effect of the parameter representing the spectrum envelope is not lost. The sound quality can be improved at the subjective level.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

We claim:

1. A speech encoding method comprising the steps of:

preparing a codebook storing a plurality of code vectors for encoding a speech signal;

producing a reconstruction speech vector by using the code vectors extracted from said codebook, and an error vector representing an error of the reconstruction speech vector with respect to a target vector corresponding to an input speech signal to be encoded;

passing the error vector through a perceptual weighting filter having a transfer function including an inverse characteristic of a transfer function of a filter for emphasizing a spectrum of the reconstruction speech signal, to generate a weighted error vector; and searching said codebook for a code vector that minimizes the weighted error vector, and outputting an index corresponding to the code vector found as an encoding parameter.

2. A method according to claim 1, wherein the producing step comprises weighting the error vector with a different weighting coefficient for each frequency of the speech signal.

3. A method according to claim 1, wherein the searching step comprises searching a plurality of codebooks for code vectors.

4. A method according to claim 3, wherein the searching step comprises converting indexes of the code vectors found in said plurality of codebooks into code sequences, multiplexing the code sequences, and outputting a multiplexed code sequence as an encoding parameter.

5. A method according to claim 3, wherein said plurality of codebooks include first and second codebooks which store code vectors for respectively removing long-term and short-term correlations of speech, and a third codebook which stores a code vector having, as elements, gains to be given to the code vectors of said first and second codebooks.

6. A method according to claim 5, wherein the searching step comprises sequentially searching said first to third codebooks for code vectors that minimize distortion, converting indexes of the code vectors found into code sequences, and multiplexing the code sequences.

7. A method according to claim 5, wherein the searching step comprises searching said first codebook for a code vector that minimizes distortion obtained by passing the code vector of said first codebook and the target vector through said perceptual weighting filter, obtaining a new target vector obtained by subtracting the code vector of said first codebook from the target vector, searching said second codebook for a code vector that minimizes weighted distortion of the code vector of said second codebook with respect to the new target vector, multiplying the code vectors extracted from said first and second codebooks by a gain of the code vector found in said third codebook, and then searching said third codebook for the code vector that minimizes weighted distortion with respect to the target vector of a reconstructed speech signal vector obtained by addition.

8. A method according to claim 5, further comprising the step of multiplying code vectors found in said first and second codebooks by a gain found in said third codebook, adding products to obtain a reconstructed speech signal vector, and updating contents of said first codebook on the basis of the reconstructed speech signal vector.

9. A method according to claim 1, further comprising the step of performing an LPC analysis for a speech signal in order to shape a noise spectrum at said perceptual weighting filter, and give an inverse characteristic of spectrum emphasis to said perceptual weighting filter.

10. A speech encoding apparatus comprising:

a codebook storing a plurality of code vectors for encoding a speech signal;

a reconstruction speech vector generator for generating a reconstruction speech vector by using a code vector extracted from said codebook;

an error vector generator for generating, using an input speech signal to be encoded as a target vector, an error vector representing an error of the reconstruction speech vector with respect to the target vector;

a perceptual weighting filter which has a transfer function including an inverse characteristic of a transfer function of a filter for emphasizing a spectrum of a reconstruction speech signal, and receives the error vector and outputs a weighted error vector;

a search searcher for searching said codebook for a code vector that minimizes the weighted error vector; and an output circuit for outputting an index corresponding to the code vector found by said searcher as an encoding parameter.

11. An apparatus according to claim 10, wherein said error vector generator comprises means for weighting the error vector with a different weighting coefficient for each frequency of the speech signal.

12. An apparatus according to claim 11, wherein said codebook comprises first and second codebooks which store code vectors for respectively removing long-term and short-term correlations of speech, and a third codebook which stores a code vector having, as elements, gains to be given to the code vectors of said first and second codebooks.

13. An apparatus according to claim 12, wherein the searcher comprises means for searching said first to third codebooks for code vectors that minimize distortion, converting indexes of the code vectors found into code sequences, and multiplexing the code sequences.

14. An apparatus according to claim 12, wherein the searcher comprises means for searching said first codebook for a code vector that minimizes distortion obtained by passing the code vector of said first codebook and the target vector through said perceptual weighting filter, obtaining a new target vector obtained by subtracting the code vector of said first codebook from the target vector, and searching said second codebook for a code vector that minimizes weighted distortion of the code vector of said second codebook with respect to the new target vector, calculation means for multiplying the code vectors extracted from said first and second codebooks by a gain of the code vector found in said third codebook, and adding the results to obtain a reconstruction speech signal vector, and means for searching said third codebook for the code vector that minimizes weighted distortion with respect to the target vector of the reconstruction speech signal vector.

15. An apparatus according to claim 14, further comprising means for updating contents of said first codebook on the basis of the reconstruction speech signal vector.

16. An apparatus according to claim 12, further comprising a predictor arranged to remove a correlation between code vectors stored in said second codebook, and a fourth codebook for controlling said predictor.

17. An apparatus according to claim 16, wherein said predictor calculates a prediction vector from a code vector extracted from said second codebook by using a coefficient matrix given as a code vector from said fourth codebook, and said searcher searches said second codebook for a code vector that minimizes weighted distortion between the prediction vector and the target vector.

18. An apparatus according to claim 10, further comprising means for performing an LPC analysis for a speech signal in order to shape a noise spectrum at said perceptual weighting filter, and give an inverse characteristic of spectrum emphasis to said perceptual weighting filter.

19. A speech encoding method comprising the steps of:

preparing a codebook storing a plurality of code vectors for encoding a speech signal;

generating a reconstruction speech vector by using the code vector extracted from said codebook, and an error vector representing an error of the reconstruction speech vector with respect to a target vector corresponding to a speech signal obtained by performing spectrum emphasis for an input speech signal to be encoded; and searching said codebook for a code vector that minimizes a weighted error vector obtained by passing the error vector through a perceptual weighting filter, and outputting an index corresponding to the code vector found as an encoding parameter.

20. A speech encoding apparatus comprising:

a codebook storing a plurality of code vectors for encoding a speech signal;

a reconstruction speech vector generator for generating a reconstruction speech vector by using a code vector extracted from said codebook;

a pre-filter for performing spectrum emphasis for an input speech signal to be encoded;

an error vector generator for generating, using a speech signal having undergone spectrum emphasis by said pre-filter as a target vector, an error vector representing an error of the reconstruction speech vector with respect to the target vector;

a perceptual weighting filter for receiving the error vector and outputting a weighted error vector;

a searcher for searching said codebook for a code vector that minimizes the weighted error vector; and an output circuit for outputting an index corresponding to the code vector found by said searcher as an encoding parameter.

* * * * *